US011059196B2

(12) United States Patent
Samari et al.

(10) Patent No.: US 11,059,196 B2
(45) Date of Patent: Jul. 13, 2021

(54) CUTTING TOOL FOR SCORING A HOSE OVER A FITTING

(71) Applicant: INTERNATIONAL BUSINESS MACHINES CORPORATION, Armonk, NY (US)

(72) Inventors: Pourya Samari, Wappingers Falls, NY (US); Eric Mallery, Poughkeepsie, NY (US); Stevana Coliukos, Kingston, NY (US); Bradley Zeman, Kingston, NY (US); James P. O'Connor, White Plains, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 400 days.

(21) Appl. No.: 16/131,284

(22) Filed: Sep. 14, 2018

(65) Prior Publication Data

US 2020/0086519 A1 Mar. 19, 2020

(51) Int. Cl.

| | |
|---|---|
| ***B26D 3/00*** | (2006.01) |
| ***B25B 27/02*** | (2006.01) |
| ***B26D 7/26*** | (2006.01) |
| ***B26D 3/08*** | (2006.01) |

(52) U.S. Cl.

CPC ..... *B26D 3/001* (2013.01); *B25B 27/02* (2013.01); *B26D 3/08* (2013.01); *B26D 7/2628* (2013.01)

(58) Field of Classification Search

CPC ... B26D 7/26; B26D 3/00; B26D 3/10; B26D 3/26; B26D 3/08; B26D 3/001; B26D 7/2628; B25B 27/02; B25B 13/10; B23D 21/10; A01G 1/00

USPC ..... 30/90.1, 90.2, 90.3, 90.4, 90.6, 90.7, 30/91.8, 90.9, 91.1, 91.2; 81/9.4, 9.51, 81/9.41–9.44; 82/92, 94; 47/6–8

See application file for complete search history.

(56) References Cited

U.S. PATENT DOCUMENTS

| | | | | |
|---|---|---|---|---|
| 2,385,368 A * | 9/1945 | Montgomery | ..... | H01B 7/36 30/90.7 |
| 2,638,899 A | 8/1953 | Beyer | | |
| 2,647,309 A | 8/1953 | Chisena | | |

(Continued)

FOREIGN PATENT DOCUMENTS

GB 2181986 A 5/1987

*Primary Examiner* — Kenneth E Peterson
*Assistant Examiner* — Nhat Chieu Q Do
(74) *Attorney, Agent, or Firm* — Tihon Poltavets, Esq.; Heslin Rothenberg Farley & Mesiti P.C.

(57) ABSTRACT

Cutting tools are provided for scoring a hose over a fitting. The cutting tool includes a handle with a central pass-through for the hose, and a scoring mechanism adjustably coupled to the handle. The scoring mechanism includes a base member with a central pass-through for the hose, and which is adjustably coupled to the handle. The scoring mechanism further includes an arm-blade subassembly coupled to the base member. The subassembly includes a blade, and an arm with a blade-receiving recess, and a guide surface to contact and travel along a hose. The blade is coupled to the arm within the blade-receiving recess to extend a selected penetration depth from the arm. The arm is radially adjustable with adjustment of the base member relative to the handle to physically contact the guide surface to the hose and insert the blade into the hose the selected penetration depth.

20 Claims, 16 Drawing Sheets

(56) References Cited

U.S. PATENT DOCUMENTS 2,830,366 A * 4/1958 Chisena ..... H02G 1/005 30/90.7
2,991,675 A * 7/1961 Ustin ..... H01R 43/0424 72/402
3,160,330 A * 12/1964 Pollitt ..... B67D 3/041 222/209
3,396,467 A * 8/1968 Scocozza ..... B23D 21/10 30/95
3,462,052 A 8/1969 Wagner
3,869,791 A * 3/1975 Horrocks ..... H02G 1/1226 30/90.1
3,888,000 A * 6/1975 Ladlow ..... B26D 3/26 30/114
3,988,826 A 11/1976 Heikkala
4,422,238 A * 12/1983 Kloster ..... F16F 9/3271 30/101
4,447,949 A * 5/1984 Kane ..... H02G 1/1229 30/90.6
4,449,298 A * 5/1984 Putz ..... H02G 1/1226 30/90.1
4,615,116 A 10/1986 Hanson et al.
4,839,986 A * 6/1989 Grantham ..... A01G 2/30 47/6
5,561,903 A * 10/1996 Bourbeau ..... H02G 1/1217 30/280
5,564,176 A 10/1996 Garcia et al.
6,378,212 B1 4/2002 Belew
6,671,962 B2 * 1/2004 Watamura ..... B26D 3/169 30/95
6,751,867 B1 * 6/2004 Whyte ..... B23D 21/08 30/101
6,889,579 B1 * 5/2005 Brown ..... B23D 21/06 81/58
7,694,420 B2 * 4/2010 Ehret ..... H02G 1/1224 30/90.1
7,748,298 B2 * 7/2010 Brown ..... B25B 13/10 81/90.2
8,209,835 B2 7/2012 Huffer et al.
8,615,863 B1 12/2013 Hope
9,184,575 B2 11/2015 Blackwell et al.
9,230,717 B1 1/2016 Manna
10,574,040 B2 * 2/2020 Troy ..... H02G 1/005
2006/0225538 A1 * 10/2006 Brown ..... B25B 13/5016 81/90.2
2007/0234858 A1 * 10/2007 Sullivan ..... H02G 1/1295 83/13
2008/0178469 A1 * 7/2008 Gutman ..... A24F 13/26 30/111
2010/0000372 A1 * 1/2010 Daggett ..... H02G 1/1229 81/9.4
2013/0152758 A1 * 6/2013 Blackwell ..... B26D 3/001 83/743
2013/0213185 A1 * 8/2013 Brown ..... B25B 27/10 81/52
2017/0110860 A1 4/2017 Repton

* cited by examiner

CUTTING TOOL FOR SCORING A HOSE OVER A FITTING

BACKGROUND

In many large computing applications, processors along with their associated electronics (e.g., memory, disk drives, power supplies, etc.) are packaged in drawer or subsystem configurations stacked within one or more racks or frames. Depending on the installation, liquid cooling (e.g., water-based cooling) may be used to assist in managing the high heat fluxes generated within such rack(s). The liquid absorbs the heat dissipated by the components/modules in an efficient manner, and the heat can ultimately be transferred from the liquid to an outside environment, whether air or other liquid coolant. Liquid cooling of one or more subsystems/drawers requires tubing and fittings to be provided within the electronics rack. Typically, space within the rack is limited, meaning that access to the tubing and fittings is often restricted should rework of the cooling or electronic system be desired.

SUMMARY

The shortcomings of the prior art are overcome and additional advantages are provided through the provision, in one aspect, of a cutting tool which includes a handle member with a central opening sized for a hose to pass therethrough, and a hose scoring mechanism adjustably coupled to the handle member. The hose scoring mechanism includes a base member with a central opening sized for the hose to pass therethrough. The base member is coupled to and adjustable relative to the handle member. When the cutting tool is in use, the hose passes through the central openings of the handle and base members. The hose scoring mechanism also includes an arm-blade subassembly adjustably coupled to the base member. The arm-blade subassembly includes a blade and an arm with a blade-receiving recess. The arm further includes a guide surface to physically contact and travel along the hose when the cutting tool is used to score the hose. The blade is coupled to the arm within the blade-receiving recess to extend from the arm a selected penetration depth of the blade into the hose. The arm is radially adjustable with adjustment of the base member relative to the handle member to facilitate physically contacting the guide surface of the arm to the hose and inserting the blade into the hose the selected penetration depth. With operative drawing of the cutting tool along the hose, the guide surface travels along the hose and the blade longitudinally scores the hose to the selected penetration depth.

In another aspect, a cutting tool is provided which includes a handle member with a central opening sized for a hose to pass therethrough, and a hose scoring mechanism adjustably coupled to the handle member. The hose scoring mechanism includes a base member, and multiple arms extending from the base member and coupled to the base member within respective radially-extending tracks of the base member. The base member includes a central opening sized for the hose to pass therethrough, and the base member is coupled to and adjustable relative to the handle member. When the cutting tool is in use, the hose passes through the central openings of the handle and base members. The multiple arms adjust within the respective radially-extending tracks with rotational movement of the base member relative to the handle member. At least one arm of the multiple arms receives a blade within a blade-receiving recess. The blade is coupled to the arm within the blade-receiving recess to extend from the arm a selected penetration depth of the blade into the hose with the multiple arms moved into physical contact with the hose for the cutting tool to be used to score the hose.

In a further aspect, a method of fabricating a cutting tool is provided. The method includes providing a handle member with a central opening sized for a hose to pass therethrough, and adjustably coupling a hose scoring mechanism to the handle member. The adjustably coupling of the hose scoring mechanism includes rotatably coupling a base member to the handle member. The base member includes a central opening sized for the hose to pass therethrough, and when the cutting tool is in use, the hose passes through the central openings of both the handle and base members. Further, adjustably coupling the hose scoring mechanism includes providing an arm-blade subassembly adjustably coupled to the base member. The providing of the arm-blade subassembly includes: providing a blade; providing an arm with a blade-receiving recess, and a guide surface configured to physically contact and travel along the hose when the cutting tool is used to score the hose; and inserting the blade into the blade-receiving recess of the arm such that the blade extends from the arm a selected penetration depth of the blade into the hose, where the arm is radially adjustable with adjustment of the base member relative to the handle member to facilitate physically contacting the guide surface of the arm to the hose and inserting the blade into the hose the selected penetration depth to facilitate the scoring of the hose using the cutting tool.

Additional features and advantages are realized through the techniques of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
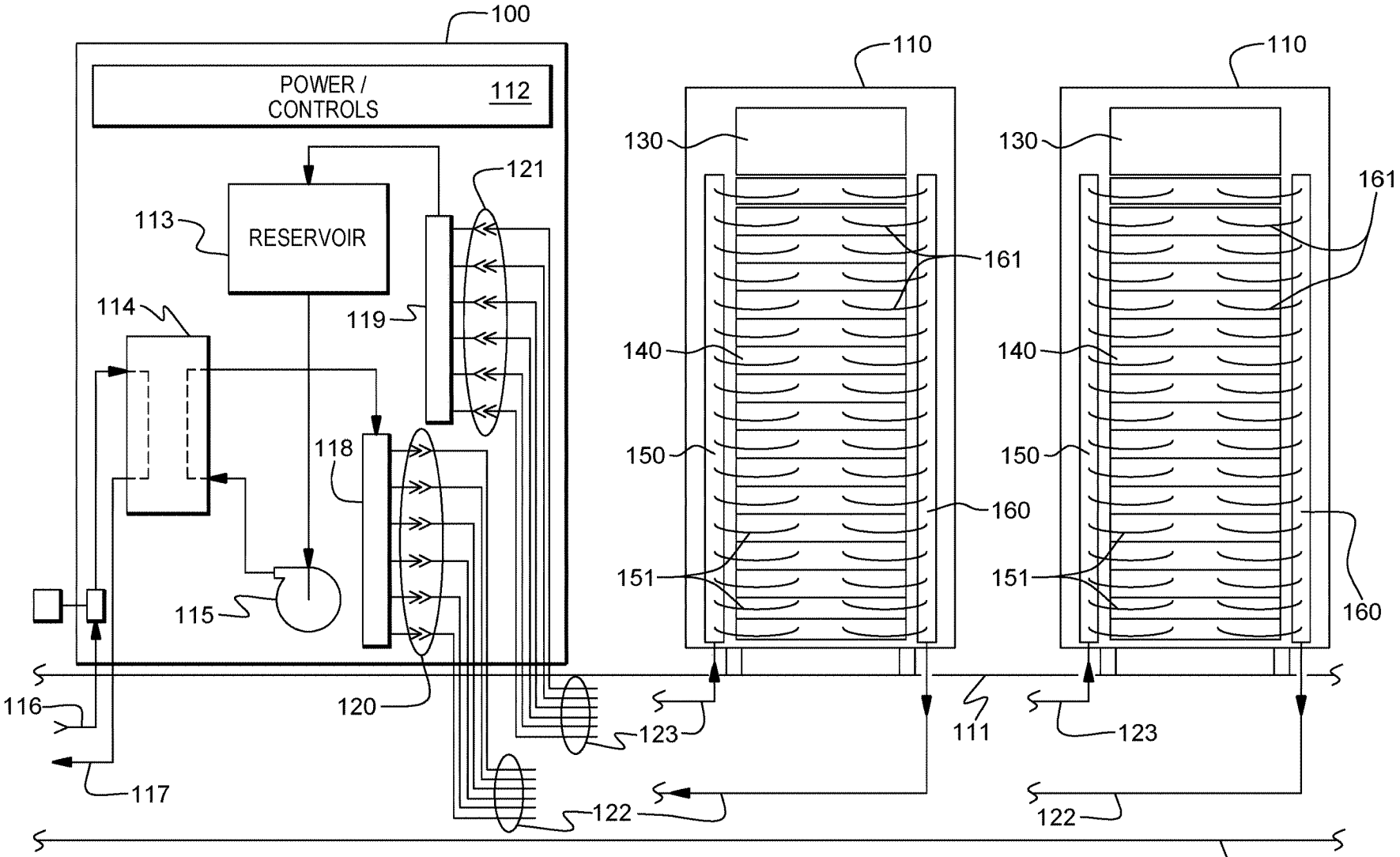
FIG. 1 depicts one embodiment of a liquid-cooled data center, within which system rework can be facilitated using a cutting tool, in accordance with one or more aspects of the present invention.

Aspects of the present invention and certain features, advantages and details thereof, are explained more fully below with reference to the non-limiting example(s) illustrated in the accompanying drawings. Descriptions of well-known materials, systems, devices, fabrication techniques, etc., are omitted so as to not unnecessarily obscure the invention in detail. It should be understood, however, that the detailed description and the specific example(s), while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure. Note that reference is made below to the drawings, wherein the same or similar reference numbers used throughout different figures designate the same or similar components. Note further that numerous inventive aspects and features are disclosed herein, and unless inconsistent, each disclosed aspect or feature is combinable with any other disclosed aspect or feature as desired for a particular application of, for instance, a cutting tool for longitudinally scoring or cutting a hose to facilitate removal of the hose from a fitting. Note in this regard that hose is used herein to refer to any conduit that can benefit from being longitudinally scored or cut as explained herein to facilitate removal of the hose from a fitting, such as a barbed fitting.

Prior to depicting various embodiments of cutting tools and methods of fabricating the cutting tools (in accordance with aspects of the present invention), one or more embodiments of a data center, electronics rack, cooling system, and hoses therefor, are described below with reference to FIGS. 1-4B. Note that in one or more implementations, the cutting tool can advantageously be employed to facilitate rework of a variety of systems, with a liquid-cooling system of an electronics rack or system being one example only. The cutting tool can be particularly advantageous where access to tubings and fittings is constrained.

Note further that the terms electronics rack and rack are used interchangeably herein, and unless otherwise specified include any housing, frame, compartment, blade server system, etc., having one or more heat generating components of a computer or electronics system. In one embodiment, an electronics rack can include one or more electronic systems or subsystems, each having one or more heat generating components disposed therein requiring cooling. Electronic system or electronic subsystem can refer to any sub-housing, blade, book, drawer, node, compartment, etc., having one or more heat generating electronic components disposed therein. An electronic system or subsystem of an electronics rack can be movable or fixed relative to the electronics rack, with rack-mounted electronic drawers of a multi-drawer rack unit and blades of a blade center system being two examples of subsystems of an electronics rack to be cooled.

Electronic component refers to any heat generating electronic component of, for example, a computer system or other electronics unit requiring cooling. By way of example, an electronic component can include one or more integrated circuit dies and/or other electronic devices to be cooled, including one or more processor dies, memory dies and memory support dies. As a further example, the electronic component can include one or more bare dies or one or more packaged dies disposed on a common carrier. Further, unless otherwise specified herein, the terms liquid-cooled structure or liquid-cooled cold plate refer to any conventional thermally conductive structure having, for instance, a plurality of channels or passageways formed therein for flowing of liquid coolant therethrough.

One example of facility coolant and system coolant is water. However, the systems discussed herein are implementable with other types of coolant on the facility side and/or on the system side. For example, one or more of the coolants can include a brine, a fluorocarbon liquid, a liquid metal, or other similar coolant, or refrigerant. In another example, the facility coolant can be a refrigerant, while the system coolant is water.

FIG. 1 depicts one embodiment of a liquid-cooled data center including a coolant distribution unit 100, and multiple electronics racks 110. The coolant distribution unit can be a relatively large unit which occupies what would be considered a full electronics frame. Within coolant distribution unit 100 is a power/control element 112, a reservoir/expansion tank 113, a heat exchanger 114, a pump 115 (often accompanied by a redundant second pump), facility water inlet 116 and outlet 117 supply pipes, a supply manifold 118 supplying water or system coolant to the electronics racks 110 via couplings 120 and lines 122, and a return manifold 119 receiving water from the electronics racks 110, via lines 123 and couplings 121. Electronics rack 110 can include (in one example) a power/control unit 130 for the electronics rack, multiple electronic subsystems 140, a system coolant supply manifold 150, and a system coolant return manifold 160. As shown, electronics racks 110 are disposed, by way of example, on a raised floor 111 of the data center (in one embodiment) and lines 123 providing system coolant to system coolant supply manifolds 150 and lines 122 facilitating return of system coolant from system coolant return manifolds 160 can be disposed in the supply air plenum beneath the raised floor.

In the embodiment illustrated, the system coolant supply manifold 150 provides system coolant to the cooling systems of the electronic subsystems (more particularly, to liquid-cooled cold plates thereof) via hose connections 151, which are disposed between the supply manifold and the respective electronic subsystems within the rack. Similarly, system coolant return manifold 160 is coupled to the electronic subsystems via hose connections 161. Quick connect couplings and/or hose barb fittings can be employed at the interface between hoses 151, 161 and the individual electronics subsystems.

Figure 2:
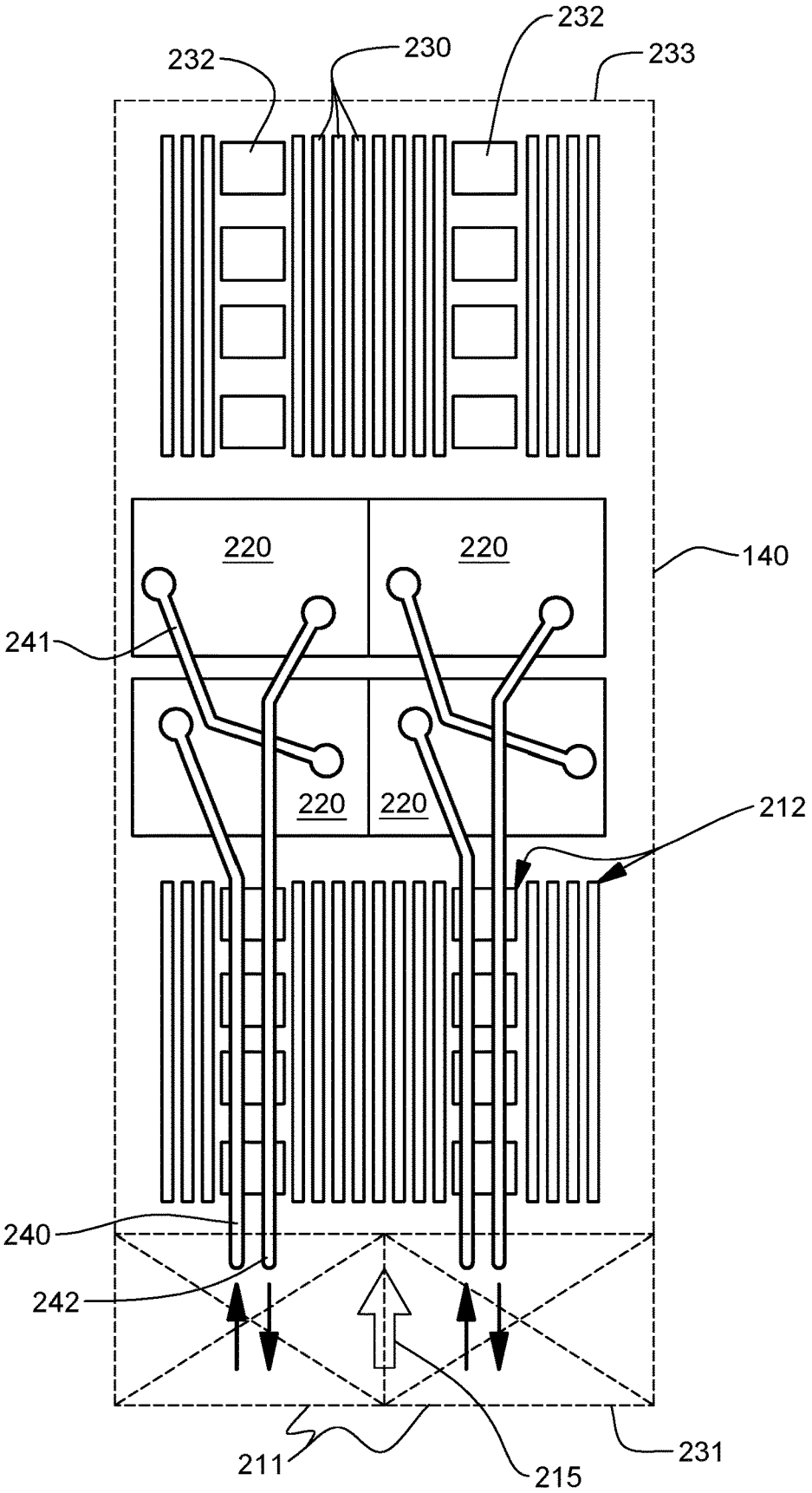
FIG. 2 is a plan view of one embodiment of an electronic subsystem layout illustrating, in part, a liquid cooling system for cooling selected components of an electronic subsystem, and within which system rework can be facilitated using a cutting tool, in accordance with one or more aspects of the present invention.

FIG. 2 depicts one embodiment of an electronic subsystem 140 component layout with one or more air moving devices 211 providing forced air flow 215 to cool multiple components 212 within electronic subsystem 140. Cool air is taken in through a front 231 and exhausted out a back 233 of the drawer. The multiple components to be cooled can include multiple processor modules to which liquid-cooled cold plates 220 (of a liquid-based cooling system) are coupled, as well as multiple arrays of memory modules 230 (e.g., dual in-line memory modules (DIMMs)) and multiple rows of memory support modules 232 (e.g., DIMM control modules) to which air-cooled heat sinks can be coupled for cooling by airflow 215. In the embodiment illustrated, memory modules 230 and the memory support modules 232 are partially arrayed near front 231 of electronics subsystem 140, and partially arrayed near back 233 of electronics subsystem 140, by way of example only.

The illustrated liquid-based cooling system further includes multiple coolant-carrying tubes connected to and in fluid communication with liquid-cooled cold plates 220. The coolant-carrying tubes can include sets of coolant-carrying tubes, with each set including (for example) a coolant supply tube 240, a bridge tube 241 and a coolant return tube 242. In this example, each set of tubes provides liquid coolant to a series-connected pair of cold plates 220 (coupled to a pair of processor modules). Coolant flows into a first cold plate of each pair via the coolant supply tube 240 and from the first cold plate to a second cold plate of the pair via bridge tube or line 241, which may or may not be thermally conductive. From the second cold plate of the pair, coolant is returned through the respective coolant return tube 242. In one embodiment, one or more of the coolant-carrying tubes depicted in the liquid-based cooling system of FIG. 2 can be hoses, such as described herein, which may need to be removed for rework of the electronic system and/or liquid-based cooling system.

Figure 3:
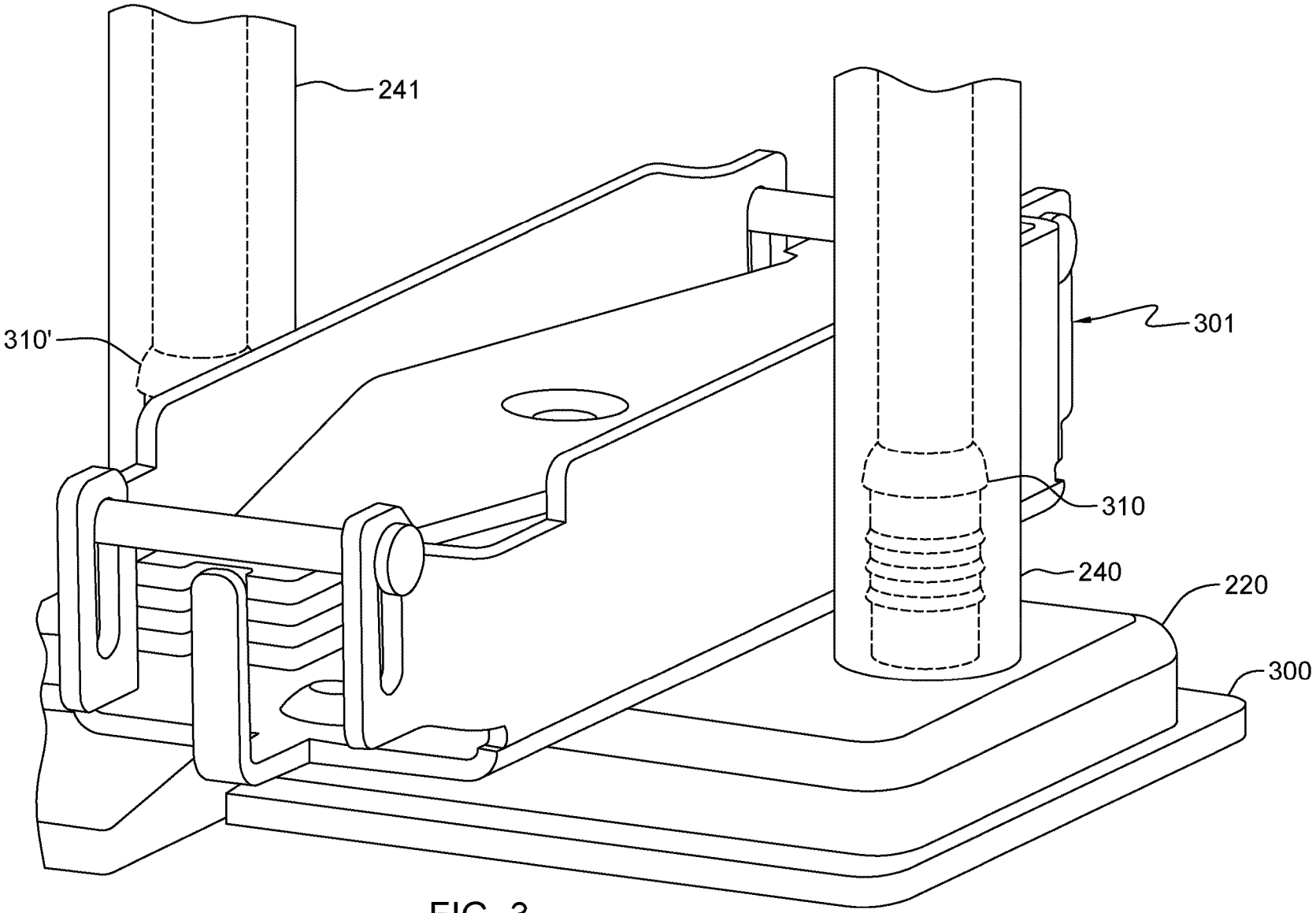
FIG. 3 depicts one embodiment of a portion of a liquid cooling system such as depicted in FIG. 2, showing a liquid-cooled cold plate attached to an electronic module, and illustrating hoses in fluid communication with the cold plate via barbed fittings, where rework of the system can be facilitated using a cutting tool, in accordance with one or more aspects of the present invention.

FIG. 3 depicts one embodiment of a portion of a liquid-cooling system such as described above in connection with FIG. 2, showing cold plate 220 attached to an electronics module 300 via, for instance, a clamping bracket 301. As illustrated in FIG. 3, a coolant supply tube 240 can connect via a fitting 310 to liquid-cooled cold plate 220 and, for instance, bridge tube or line 241 can connect via another fitting 310' to liquid-cooled cold plate 220. In one or more embodiments, fittings 310, 310' can be barbed fittings formed, for instance, of metal, or a metal alloy. Barb fittings are a common attachment point used for hoses, such as rubber hoses, to ensure a secure and water-tight seal. Removing a hose from a barb fitting, such as depicted in FIG. 3, can prove to be difficult, and potentially cause damage to the barb fitting, with any damage to a barb opening up the possibility for a potential leak channel after reattachment of hoses to the fittings after rework of the electronic and/or cooling system.

Figure 4A:
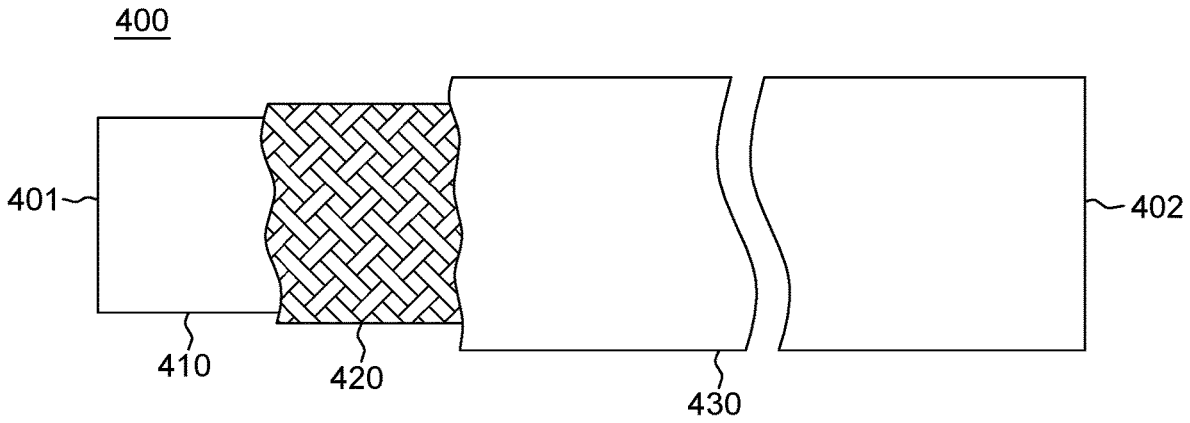
FIG. 4A is a schematic of one embodiment of a hose with a reinforcement layer over an innermost elastomer layer useful in a liquid-cooling system such as depicted in FIGS. 1-3, and which can be scored for system rework using a cutting tool, in accordance with one or more aspects of the present invention.
Figure 4B:
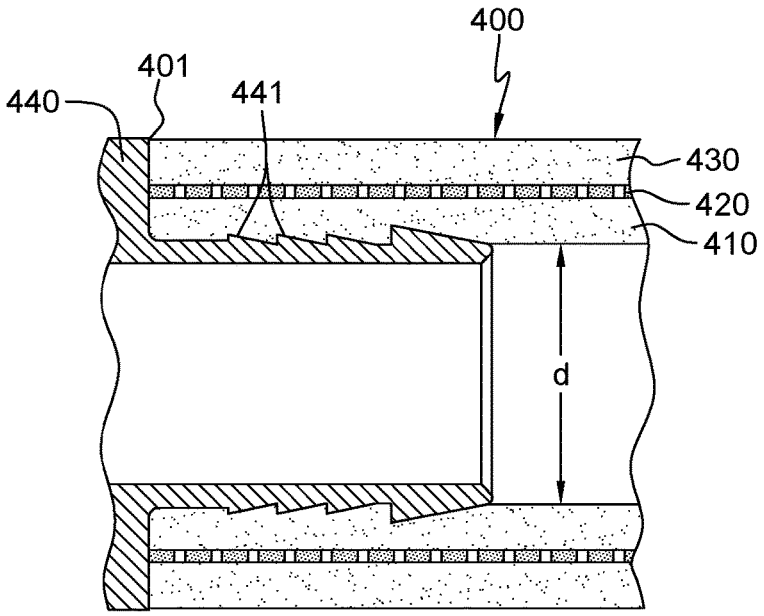
FIG. 4B depicts the hose of FIG. 4A, with one end thereof positioned over a hose barb fitting, wherein the fiber-reinforcement layer facilitates providing a desired mechanical, fluid-tight connection with a relatively high internal burst pressure point, absent any clamp over the hose and hose barb fitting connection, and for which system rework can be facilitated using a cutting tool, in accordance with one or more aspects of the present invention.

One or more of the hoses of the liquid-cooling system of FIGS. 1-3 can be or include flexible hoses, such as rubber hoses. FIGS. 4A & 4B depict two examples of a deformable hose end slid over to attach to a barb fitting to form a mechanical, fluid-tight connection therewith. By way of example, the hose barb fitting could facilitate coupling of a quick connect coupling to the hose end, which can then be employed to couple the hose within a liquid-cooled system, such as described above, or the barb fitting itself could couple or be the connection of the hose into the system.

Referring to FIG. 4A, depicts one embodiment of a hose 400 with a braided fiber reinforcement layer is depicted. As illustrated, hose 400 includes an innermost elastomer layer 410, a fiber-reinforcement layer 420, and an outermost elastomer layer 430. The inner and outer elastomer layers can be fabricated of the same or different elastomeric material. In one specific example, the inner and outer elastomer layers 410, 430 can include a rubber material. In the example depicted, the middle fiber-reinforcement layer 420 can include or be a braided fiber-reinforcement layer, which is a relatively high-density, fiber reinforcement, such as illustrated. This high-density-rated fiber reinforcement can extend from a first end 401 to a second end 402 of the hose, and advantageously provides hose 400 with a relatively high burst pressure point, including at the end 401 where coupled to a barb fitting 440, such as shown in FIG. 4B, without the use of any clamp over the deformable hose and fitting connection.

Note that the burst pressure point, or internal burst pressure point, refers to the internal pressure of the hose necessary to, for instance, cause the hose-fitting connection to leak, or for the hose to disconnect from the fitting. The burst pressure is the internal pressure within the hose needed to, for instance, overcome any compressive force on the fitting resulting from the fiber-reinforcement layer within the hose, and the tight sliding of the hose over the fitting.

As shown in FIG. 4B, fitting 440, which can be fabricated of a metal, such as stainless steel, copper, aluminum, etc., includes one or more raised features (or barbs) 441 on an exterior surface thereof. Fitting 440 and/or hose 400 are fabricated so that the outer diameter of the fitting and inner diameter 'd' of the hose are sized or slip (or friction fit) together, with the hose end deforming somewhat to accommodate barbs 441 of fitting 440. Limiting the deformation of hose 400 is a compressive force which is generated by the fiber-reinforcement layer 420 comprising the high-density reinforcement. As a result, the end of hose 400 forms a good, mechanical, fluid-tight connection with fitting 440, without the need for a clamp over the hose-fitting connection.

Removal of a hose, such as hose 400, from a fitting, such as barb fitting 440, can be facilitated by partially cutting or scoring the hose to reduce the compressive force holding the hose against the fitting. In one or more approaches, this process could be completed using a hand-held box cutter or similar tool to manually cut the outer jacket of the hose to a desired depth. However, using a box cutter or similar tool can be an inherently imprecise operation. For instance, if the box cutter penetrates too deep and contacts the barb fitting during cutting of the hose, damage to the barb or fitting can occur, which then opens up the possibility of a potential leak channel after reattachment of a hose to the fitting.

To address this, disclosed herein with reference to FIGS. 5A-10 are various hand-held cutting tools, which allow a user to cut or score a hose in a single motion to a predetermined depth, removing the possibility of fitting damage or operator error in the process. The cutting tools disclosed are advantageously adjustable for different size hoses and fittings, and allow the user to score or slit the hose at or near a joint, barb fitting, fitting, etc., in an axial or longitudinal direction, without damage or contact to the fitting. The cutting tools disclosed herein allow an operator to precisely cut a hose over, for instance, a barbed fitting by scoring the hose to only a predetermined depth into the hose. The cut or cuts produced by the tool decrease the wall thickness of the hose over the fitting, weakening the hose structure, which allows the hose to then be readily removed from the fitting. For instance, in one or more embodiments, the blade penetration depth of the cutting tool can be set such that the cutting tool cuts through, for instance, an outermost elastomer layer 430, and a reinforcement layer 420, but not the innermost elastomer layer 410, in the case of a hose such as described above in connection with FIGS. 4A & 4B. Further, the cutting tools disclosed herein advantageously hold the blade or blades at a specific angle and depth relative to the hose, which removes the possibility of operator-induced variability or error in the scoring operation.

Figure 5A:
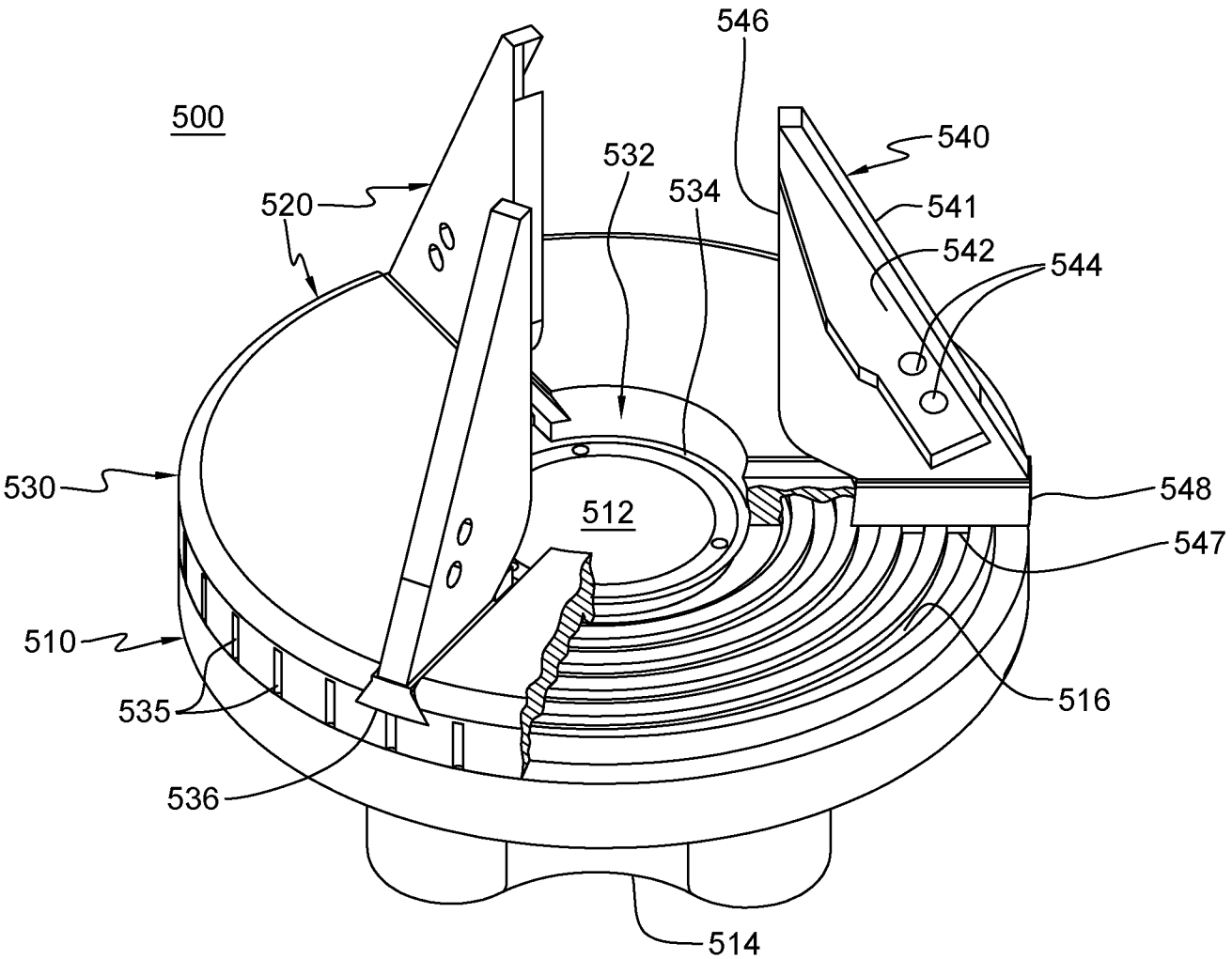
FIG. 5A is a partial cutaway depiction of one partially assembled embodiment of a cutting tool, in accordance with one or more aspects of the present invention.

By way of example, FIG. 5A depicts a partial cutaway view of a partially assembled cutting tool 500, in accordance with one or more aspects of the present invention. As shown, cutting tool 500 (in one embodiment) includes a handle member 510 with a central opening 512 sized for a hose (not shown) to pass therethrough, and a hose scoring mechanism 520 adjustably coupled to handle member 510. Hose scoring mechanism 520 includes, in one or more embodiments, a base member 530 with a central opening 532 also sized for the hose to pass therethrough. Base member 530 is adjustable relative to (for instance, rotatably coupled to) handle member 510, and when cutting tool 500 is in use, the hose to be scored passes through the aligned central openings of handle member 510 and base member 530. Hose scoring mechanism 520 further includes one or more arm-blade subassemblies 540, with arms 541 being shown in FIG. 5A, and blades 543 of arm-blade subassemblies 540 shown in position in FIG. 5C.

In the embodiment shown, each arm 541 includes a respective blade-receiving recess 542, with one or more openings 544 for securing a respective blade within the blade-receiving recess 542. Two openings 544 are shown by way of example to provide one level of adjustment of the blade relative to the arm, as explained further herein. Each arm 541 further includes, in the embodiment depicted, a guide surface 546 which is configured and located to physically contact and travel along the periphery of a hose when cutting tool 500 is used to score the hose. As explained herein, each blade is adjustably coupled to a respective arm 541 within blade-receiving recess 542 to extend from the arm a selected penetration depth of the blade into the hose. Position of each arm 541 radially adjusts relative to the hose extending through the cutting tool with adjustment of base member 530 relative to handle member 510. For instance, in the example depicted, base member 530 includes radially-extending dove-tailed tracks 536 within which a support base 548 of an arm 541 resides and is movable within.

In the embodiment depicted, each support base 548 includes, or has extending therefrom, one or more teeth 547, which extend into a spiral groove 516 in the end surface of handle member 510, where base member 530 rotatably couples to handle member 510. In this manner, rotation of base member 530 relative to handle member 510 simultaneously moves the support bases 548 of arms 541 within the spiral groove, providing radial adjustment of the position of the arms 541. For instance, by rotating the base and handle members relative to each other, the arms can be moved simultaneously inward a sufficient distance for guide surface 546 of each arm to contact the hose, and for the blade of each arm-blade subassembly 540 to insert into the hose the selected penetration depth (that is, the distance which the blade extends from the arm). Note that the three arm-blade subassembly embodiment of FIG. 5A, where the arm-blade subassemblies 540 are offset 120° from each other, is presented by way of example only.

Also note that, in the embodiment depicted, cutting tool 500 is a hand-held cutting tool, and handle member 510 is configured with indents 514 or other structures to facilitate manual gripping of the handle member. Similarly, base member 530 of hose scoring mechanism 520 can include indents 536 along an outer periphery thereof, or other structures to facilitate manual gripping of the base member to assist with rotation of the base member relative to the handle member, as discussed herein.

In one or more embodiments, assembling cutting tool 500 can include inserting the arms 540 into the respective dove-tail tracks 536 in base member 530 from center opening 532. Note that base member 530 can be configured such that each dove-tail track prevents the respective arm from sliding radially outward away from the base member when positioned within the track. In the embodiment depicted, base support 548 of each arm 540 is configured with angled sidewalls to facilitate the arm being retained within the respective dove-tail track 536 of the base member 530, while still allowing for radial adjustment of the position of the arm.

The assembling can also include bringing handle member 510 up into contact with base member 530 with teeth 547 (of arms 541) extending into the spiral groove 516 of handle member 510. In one or more embodiments, handle member 510 can be designed with an outer peripheral shelf (not shown), upon which the base member sits for rotatable movement of base member 530 relative to handle member 510.

Figure 5B:
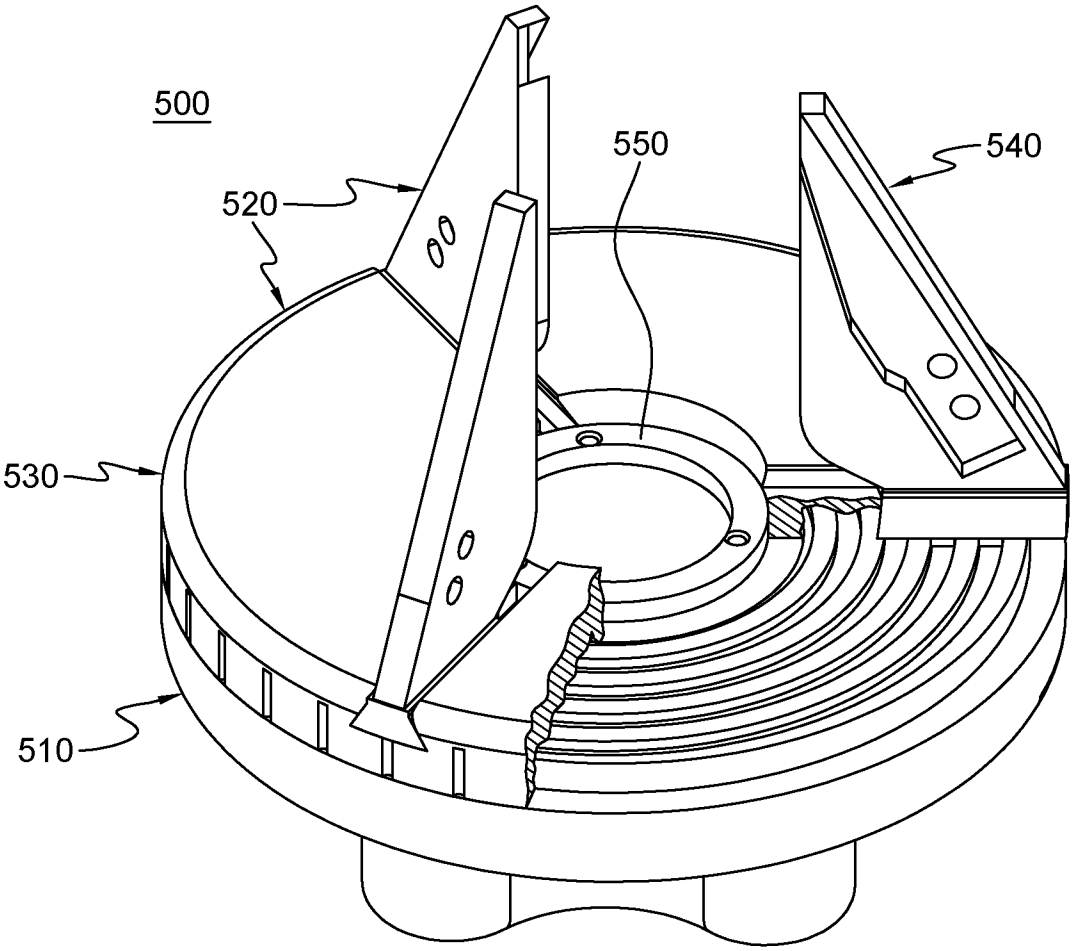
FIG. 5B depicts the tool assembly of FIG. 5A with a retaining collar shown in place, in accordance with one or more aspects of the present invention.

In one or more embodiments, the radius of central opening 512 in handle member 510 can be slightly smaller than the radius of central opening 512 in base member 530 to provide an inner shelf upon which to affix a retaining collar 550 onto handle member 510 with base member 530 in place, as shown in FIG. 5B. Retaining collar 550 is configured to overly an inner lip of base member 530, and can be held in place by appropriate fasteners extending through retaining member 550 into handle member 510, with a sufficient gap being provided between the retaining member and base member 530 to allow for rotating of base member 530 and handle member 510 relative to each other.

Figure 5C:
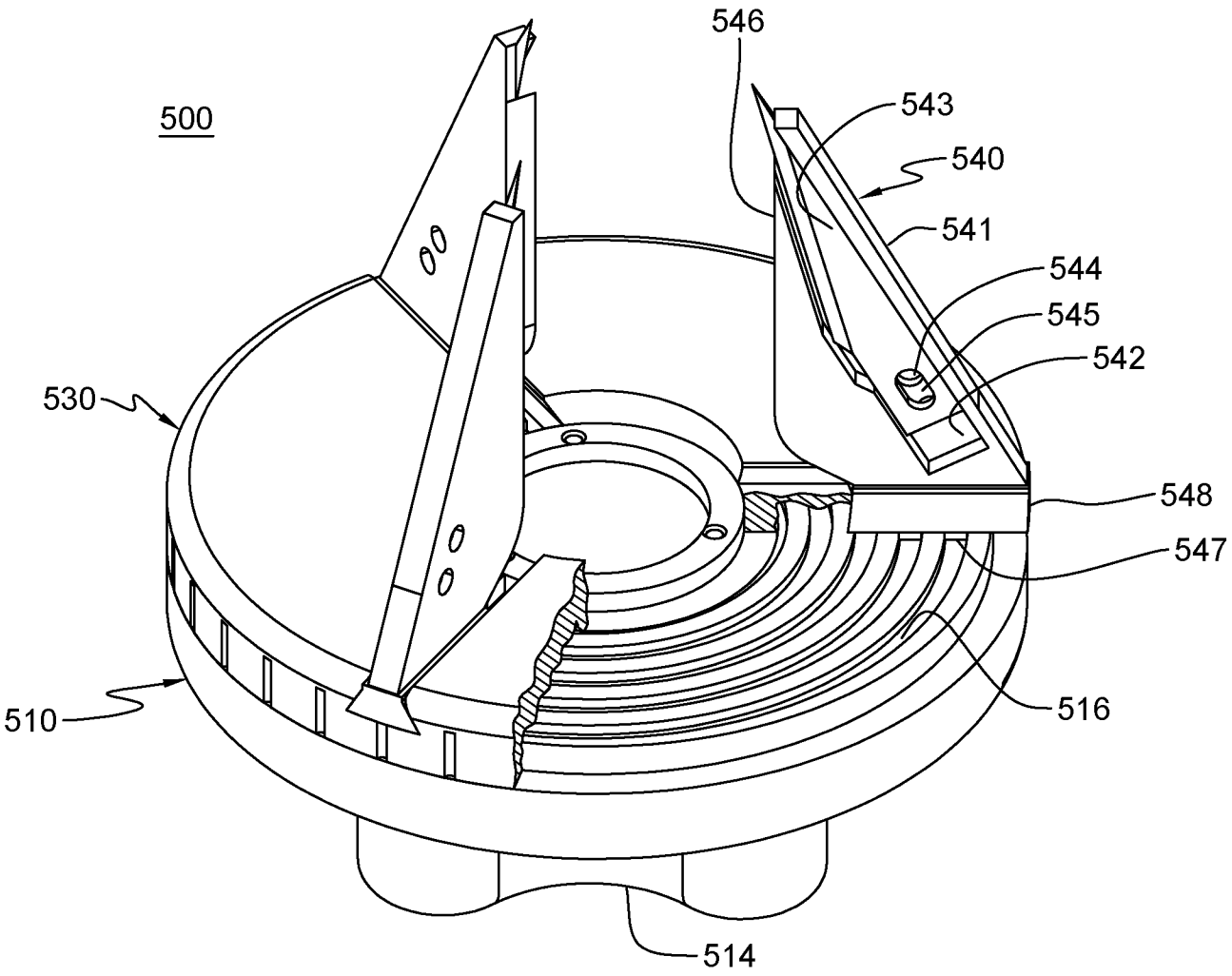
FIG. 5C depicts the cutting tool of FIG. 5B, with blades inserted into respective blade-receiving recesses in the arms of the assembly, in accordance with one or more aspects of the present invention.
Figure 5D:
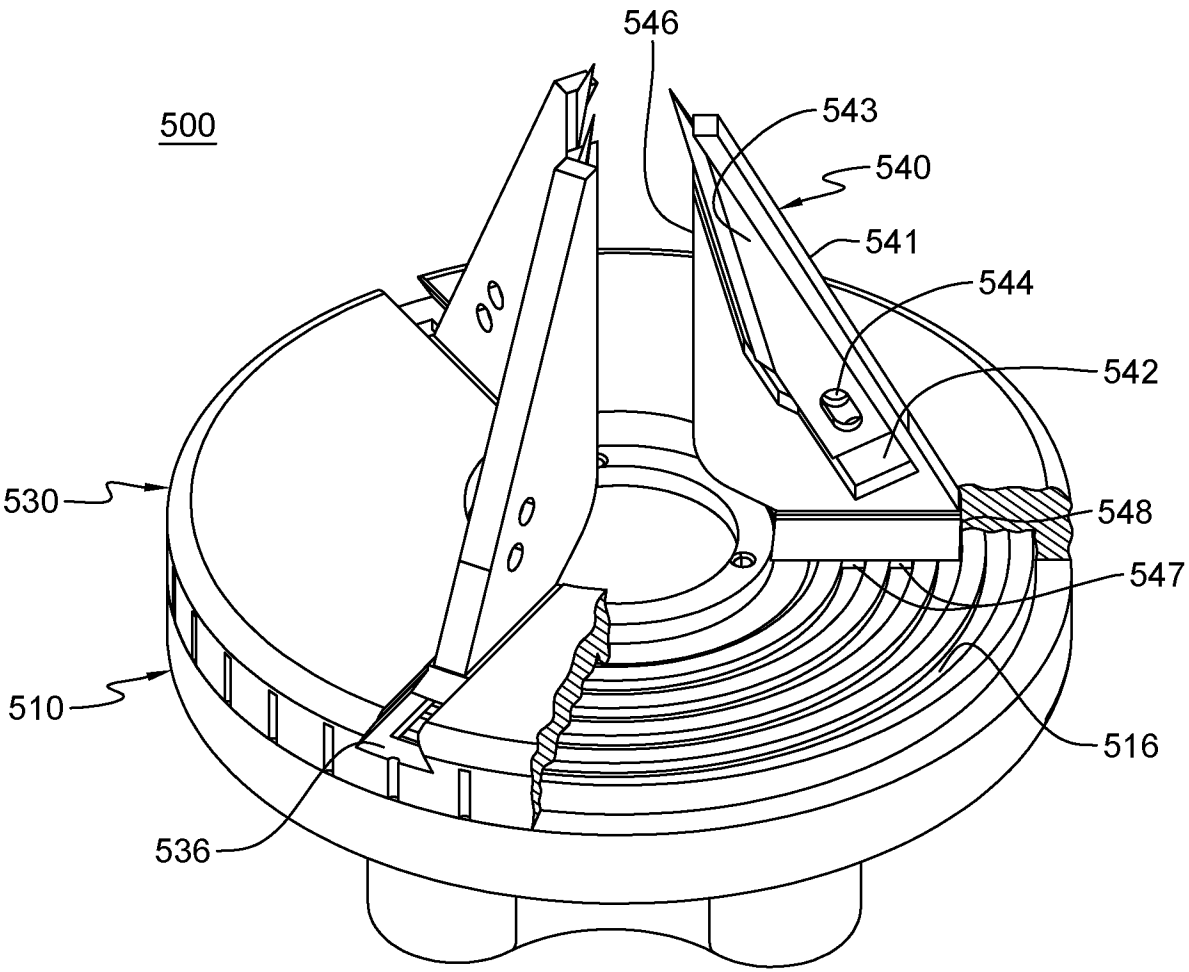
FIG. 5D depicts the cutting tool of FIG. 5C, with the arms of the cutting tool shown transitioned to a closed position, in accordance with one or more aspects of the present invention.

In FIG. 5C, blades 543 are shown in position within respective blade-receiving recesses 542 of arms 541. In one or more embodiments, each blade 543 has an oblong opening 545 which allows for another level of adjustment of the position of the blade relative to the openings 544. Note that in one or more embodiments, each blade can be set to extend from the respective arm a same penetration depth such that when the cutting tool is in use, the hose is scored to the same penetration depth in multiple locations about the hose. In one or more implementations, fasteners, such as threaded fasteners (not shown), can be employed to secure a blade 543 to the respective arm 541 in the desired position. In FIG. 5C, arms 541 are shown in a radially-outer, full-open position to, for instance, facilitate placement of the cutting tool over a hose to be scored. In FIG. 5D, cutting tool 500 is shown with arms 541 of the arm-blade subassemblies 540 shown transitioned radially inward to, for instance, a full-closed position.

Note that blade-receiving recesses 542 in arms 541 can each be similarly configured such that blades 543 extend at a common angle from each respective arm, relative to inner guide surfaces 546 (or the hose being scored). Note that if a smaller cut diameter is desired than achievable by adjusting blades 543, then the rake angle of the arms could be increased, but at the expense of device compactness. Compactness of the device can be particularly beneficial depending upon where the cutting tool is to be applied. In one or more implementations, to articulate between full-open and full-close positions, the base member can be held stationary, and the handle member rotated axially. As the teeth slide within the spiral groove, the arms are moved either radially inward or radially outward, depending on the direction of rotation.

Figure 5E:
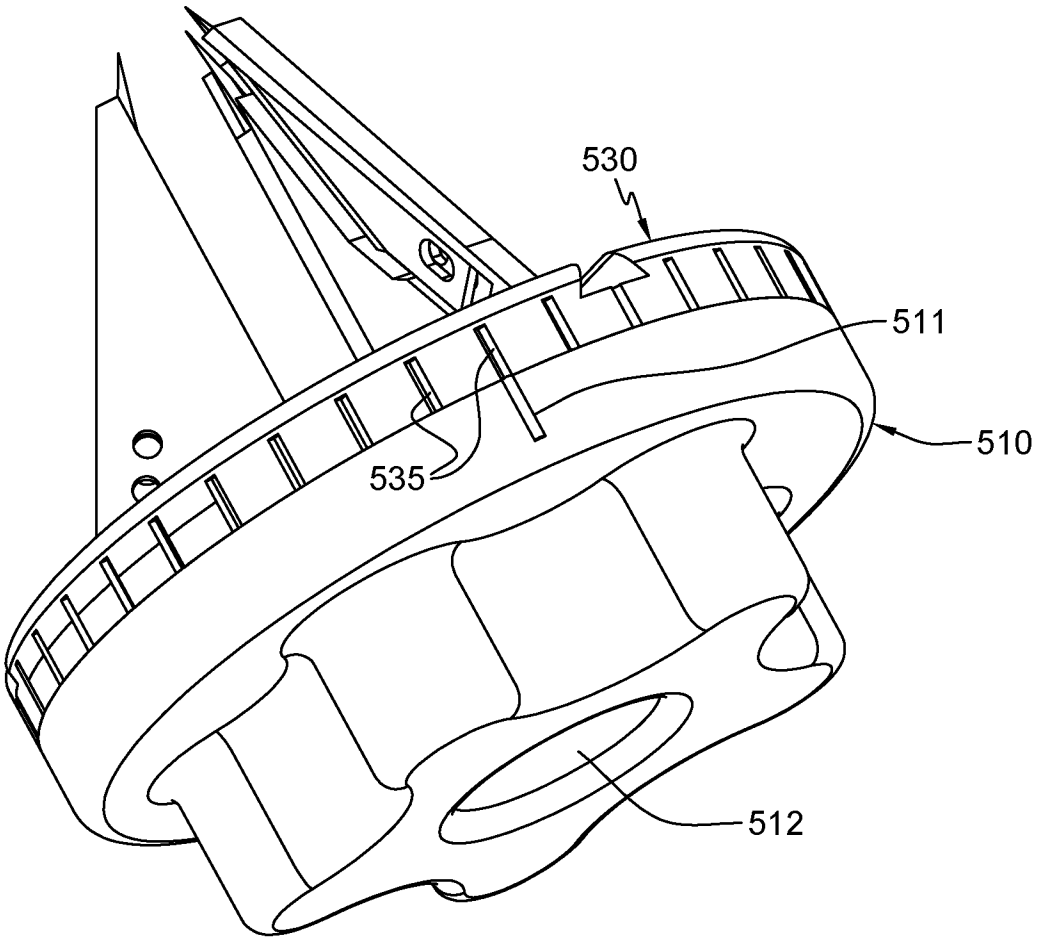
FIG. 5E depicts the cutting tool of FIGS. 5A-5D partially enlarged to depict one or more indexing elements for reference in adjusting the arms of the cutting tool, in accordance with one or more aspects of the present invention.

FIG. 5E depicts cutting tool 500 of FIGS. 5A-5D, with an index line 511 on handle member 510 which, in one or more embodiments, can align with indents 535 in base member 530 at different rotational positions of the base member relative to the handle member to facilitate adjusting position of the arms to a set location. Additionally, in one or more embodiments, appropriate numbering can be provided for various indexing marks to facilitate operator use of the cutting tool.

Figure 6A:
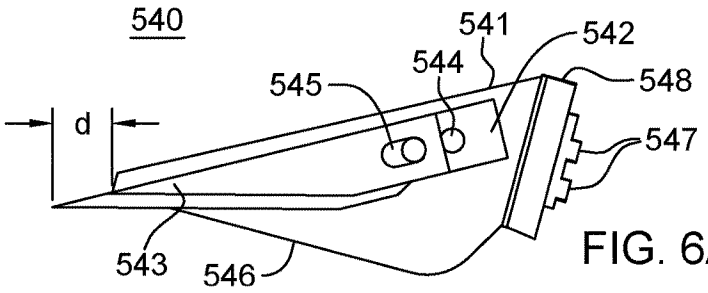
FIGS. 6A-6D depict different adjustments of a blade within a blade-receiving recess of an arm of a cutting tool, such as the cutting tool of FIGS. 5A-5E, and showing adjustment of the distance the blade extends from the arm, and thus selection of different blade penetration depths, in accordance with one or more aspects of the present invention.
Figure 6B:
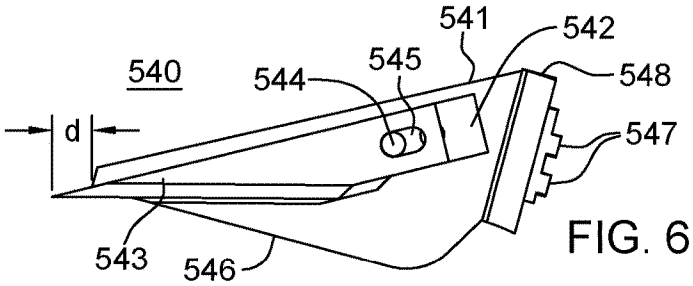
Figure 6C:
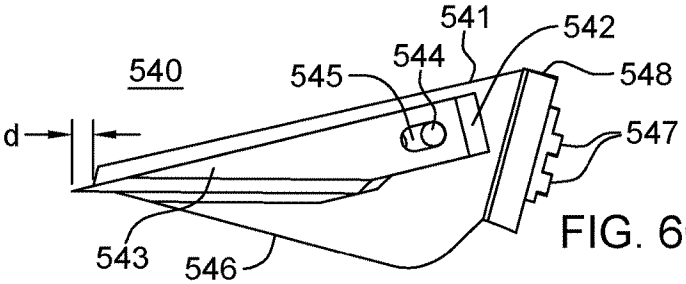
Figure 6D:
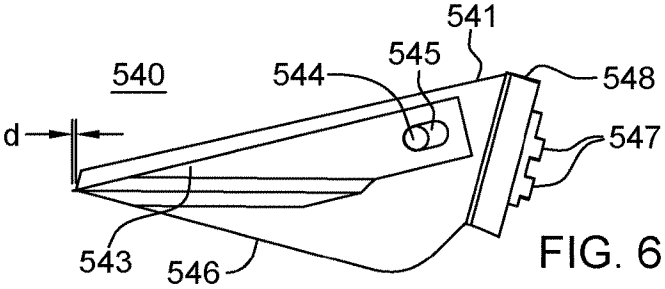

FIG. 6A depicts further details of one embodiment of arm-blade subassembly 540, in accordance with one or more aspects of the present invention. As illustrated, blade 543 resides within blade-receiving recess 542 of a respective arm 541. Arm 541 includes, in one or more embodiments, two or more openings 544, and blade 543 includes an enlarged, oblong slot 545, which overlies at least one opening 544, and allows for the penetration depth 'd' to which blade 543 extends out from the arm, and in particular, from guide surface 546, to be adjusted. Adjusting of the blade relative to the arm allows for a particular cut depth to be set for the tool. As noted, in one or more embodiments, the cut depth might be selected to allow blade 543 to cut through, for instance, an outer elastomer layer of the hose, as well as any middle reinforcement layer(s), leaving only an inner elastomer layer(s) of the hose intact over a fitting, thereby weakening the pressure with which the hose is held in place on the barb fitting, and thus facilitating manual removal of the hose from the fitting. FIGS. 6B-6D depict arm-blade subassembly 540 of FIG. 6A, with the blade shown in different positions relative to the blade-receiving recess, and in particular, the oblong slot of the blade being shown aligning to different openings 544 in arm 541 to extend the blade at different depths 'd' from the arm. As noted, an appropriate fastener (not shown) can be used to secure the blade to the arm at the desired location.

Figure 7A:
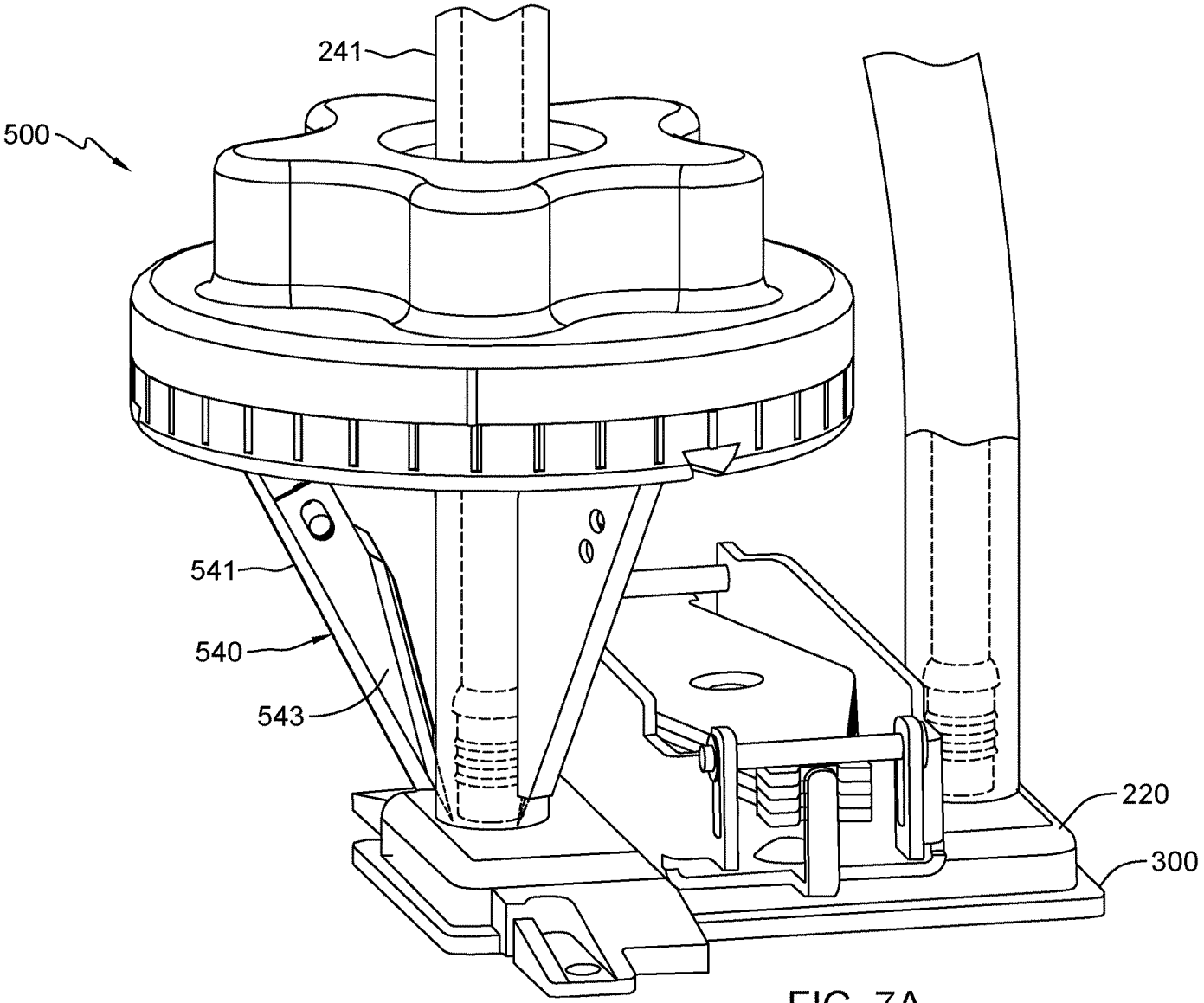
FIG. 7A depicts use of the cutting tool of FIGS. 5A-5E to longitudinally score a hose disposed over a barbed fitting of a liquid-cooling system such as depicted in FIG. 3, in accordance with one or more aspects of the present invention.
Figure 7B:
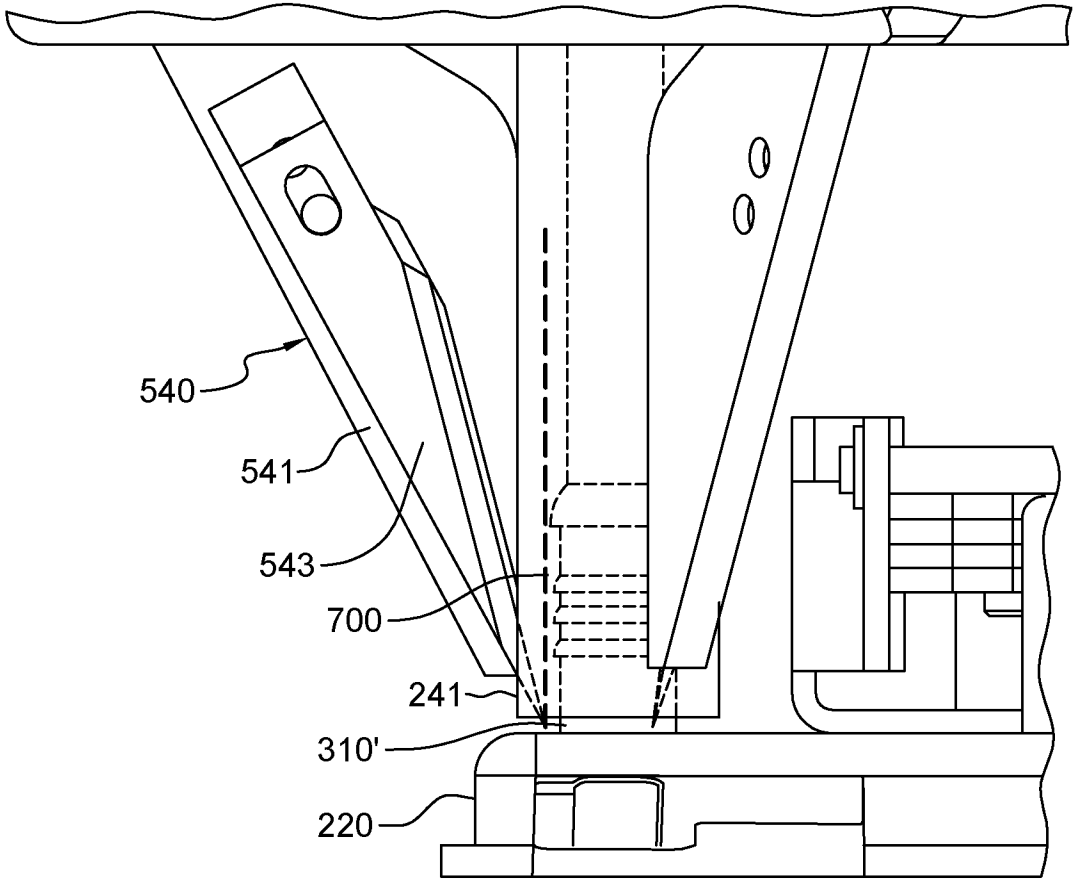
FIG. 7B is an enlarged depiction of the cutting tool and hose of FIG. 7A, and showing the selected penetration depth of the blade into the hose not contacting the barbs of the barbed fitting, in accordance with one or more aspects of the present invention.

By way of example, FIGS. 7A & 7B depict the liquid-cooling system and electronic module of FIG. 3, with cutting tool 500 of FIGS. 5A-6D shown in operation to score, or partially cut into, hose 241 over fitting 310'. In use, the cutting tool can be slid over a free end of hose 241, with the cutting tool in the open position, and then adjusted down to the proper cut depth, for instance, until the respective guide surfaces contact the outer periphery of the hose, with the blades being similarly preset to extend a common distance from the respective guide surfaces, and thus, to penetrate into the hose a common distance. As noted, the penetration depth of the blades into the hose can be selected such that the blades will not contact the fitting 310', or more particularly, the barbs of the fitting, and thus, will not result in nicks or channels being cut into the barbs with scoring of the hose to, for instance, facilitate removal of the hose for rework of the liquid-cooling system. This is depicted in FIG. 7B, where the cut path 700 is shown spaced from barb fitting 310' so as not to damage the barbs or fitting. Once the blades are set to the penetration depth within the hose, the cutting tool can be drawn axially along the hose a sufficient distance to cut the end of the hose over the barb fitting, and thereby weaken the connection of the hose to the fitting, allowing an operator to readily manually remove the hose from the fitting. Note that due to the tight clearances in relation to clamping bracket 301, cutting tool 500 can be specially configured and sized as described herein.

Figure 8:
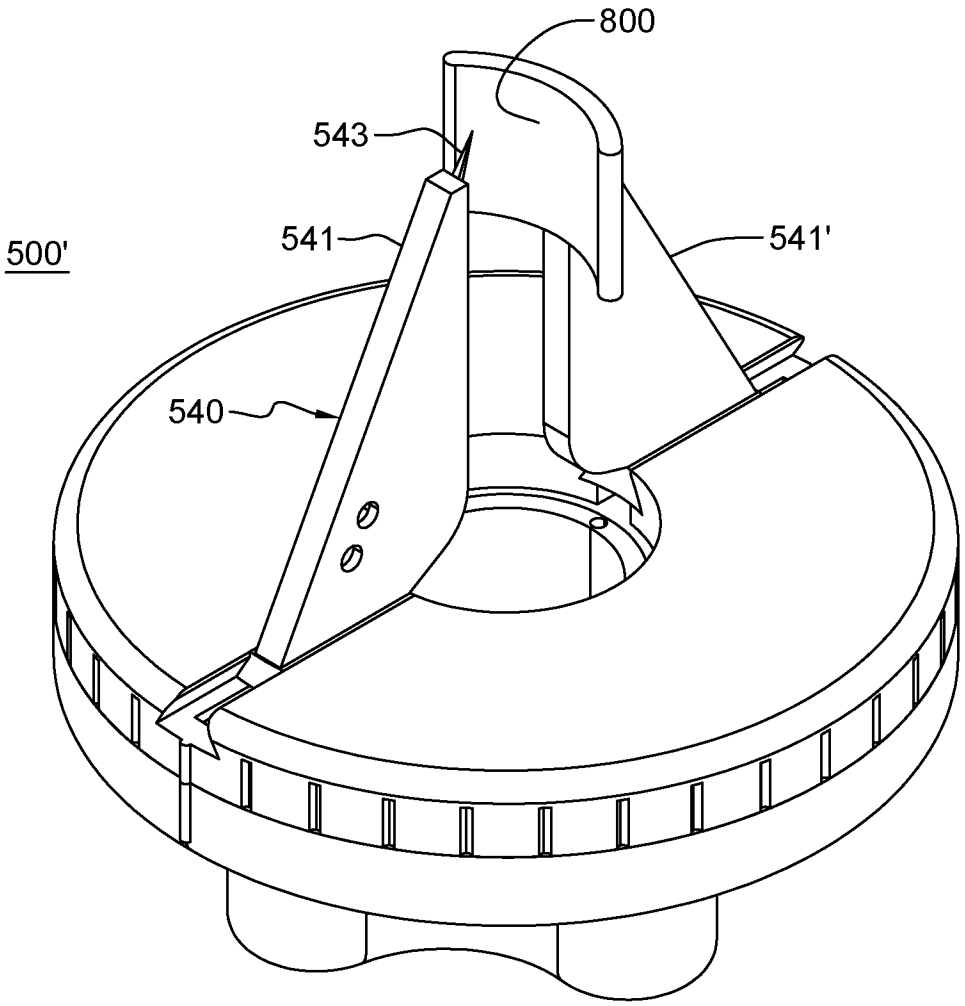
FIG. 8 depicts an alternate embodiment of a cutting tool, in accordance with one or more aspects of the present invention.

FIG. 8 depicts another embodiment of a cutting tool 500', substantially as described above in connection with cutting tool 500, but with a single arm-blade subassembly 540 in combination with a scoring support arm 541', which includes a concave scoring support surface 800 sized and configured to physically contact the hose when the tool is in use. As shown, in one or more embodiments, scoring support arm 541' with concave scoring support surface 800 can be located in opposing relation to arm-blade subassembly 540 of cutting tool 500'. In this manner, the concave scoring support surface helps to support the hose (not shown) when cutting tool 500' is used in operation to score the hose. In operation, after scoring the hose, blade 543 can be withdrawn from the hose by rotating the handle member in a direction to move arms 541, 541' radially outwards. If desired, the process can be repeated to score the hose in one or more additional locations.

Figure 9A:
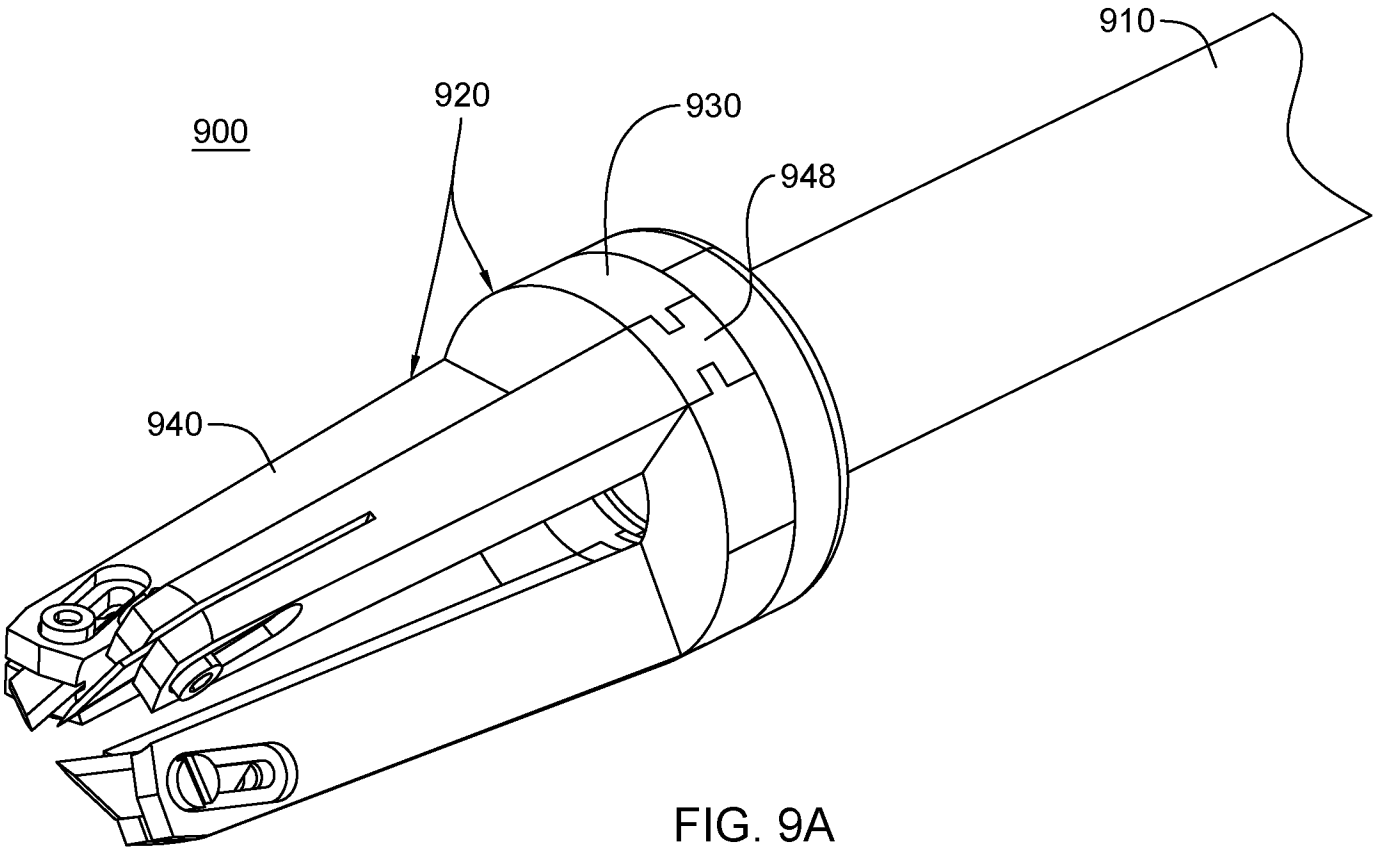
FIG. 9A depicts a further alternate embodiment of a cutting tool, in accordance with one or more aspects of the present invention.
Figure 9B:
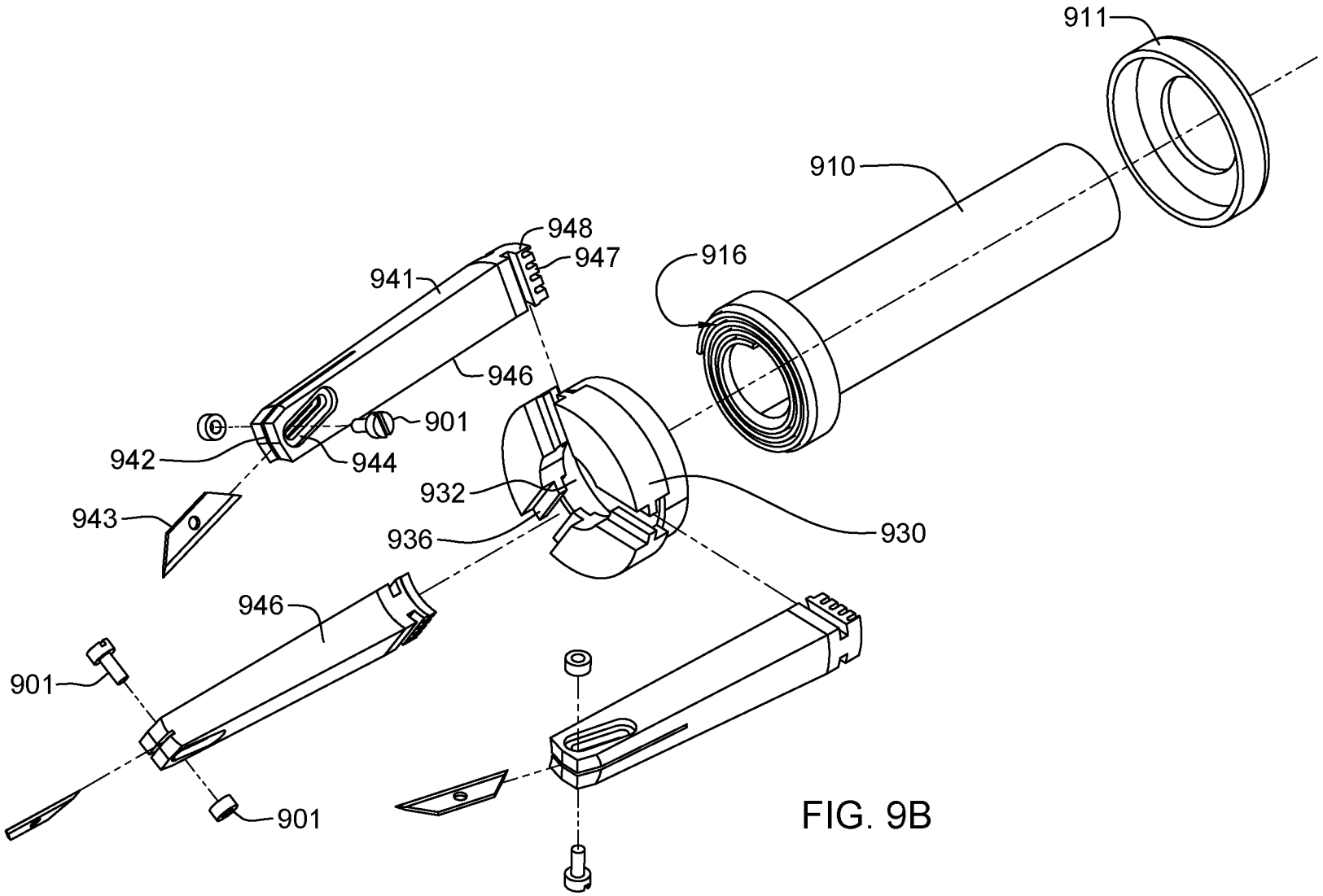
FIG. 9B is an exploded view of the cutting tool of FIG. 9A, in accordance with one or more aspects of the present invention.

FIGS. 9A & 9B depict an alternate embodiment of a cutting tool 900, in accordance with one or more aspects of the present invention. Referring collectively to FIGS. 9A & 9B, cutting tool 900 is similar in components and operation to cutting tool 500 described above in connection with FIGS. 5A-7B. In the configuration of FIGS. 9A & 9B, cutting tool 900 includes an elongate handle member 910 with a central opening sized for a hose to pass therethrough, and a hose scoring mechanism 920 adjustably coupled to handle member 910 so as to be rotatable relative to the handle member. Hose scoring mechanism 920 includes a base member 930 with tracks 936 configured to receive a support base 948 of a respective arm-blade subassembly 940 of hose scoring mechanism 920. In the exploded view of FIG. 9B, handle member 910 is shown to include a retaining ring 911 within which the base member 930 resides when the cutting tool is assembled as depicted in FIG. 9A.

Arm-blade subassemblies 940 each include a respective arm 941 with teeth 947 extending from a support base 948 into, for instance, a spiral groove 916 in the end of handle member 910 to which scoring mechanism 920 is rotatably coupled. In this manner, arm-blade subassemblies 940 are radially adjustable by rotating handle member 910 and base member 930 relative to each other so as to position the subassemblies at a desired radial location relative to the hose passing through the tool. As with the cutting tool described above in connection with FIGS. 5A-7B, base member 930 also includes a central opening 932 for the hose to pass therethrough when the cutting tool is in use. In this embodiment, each arm 941 includes a respective blade-receiving recess 942 with an elongate slot extending through the arm 941 intersecting the blade-receiving recess 942 to allow for adjustably securing a respective blade 943 within blade-receiving recess 942 using, for instance, fasteners 901. In operation, the penetration depth can be set by setting the distance that each blade 943 extends from the respective arm 941 to be equal, and to be a sufficient distance to score the hose to a desired depth without contacting a fitting over which the hose resides, as explained above in connection with FIGS. 7A & 7B. Each arm 941 may further include a guide surface 946 on the inside of the arm to at least partially contact the hose when cutting tool 900 is in use.

Figure 10:
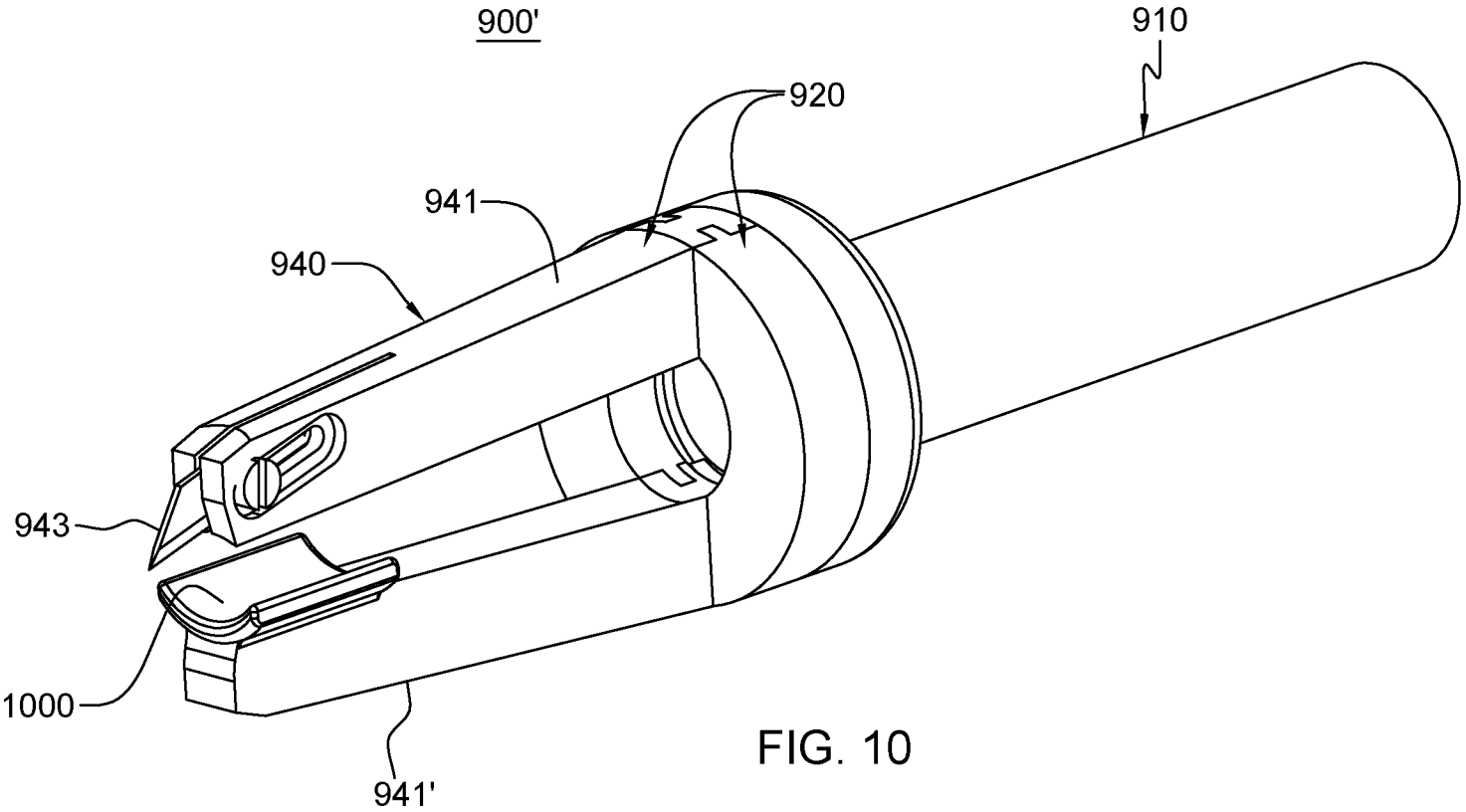
FIG. 10 depicts an alternate embodiment of the cutting tool of FIGS. 9A-9B, in accordance with one or more aspects of the present invention.

FIG. 10 depicts another embodiment of a cutting tool 900' similar to cutting tool 500' of FIG. 8, wherein hose scoring mechanism 920 includes a scoring support arm 941' with a concave scoring support surface 1000 sized and configured to physically contact the hose when the cutting tool 900' is being used to score a hose. The scoring support arm 941' with the concave scoring support surface 1000 can be located in opposing relation to an arm-blade subassembly 941 of the cutting tool to stabilize the cutting tool when scoring the hose. For instance, concave scoring support surface 1000 can be located opposite to blade 943 of arm-blade subassembly 940, as shown in FIG. 10.

Those skilled in the art will note from the above discussion that provided herein is a cutting tool for longitudinally cutting a rod-shaped structure, generally referred to herein as a hose. The cutting tool includes a scoring mechanism coupled to a handle member, where the scoring mechanism includes at least one blade that is radially adjustable by the handle member. Both the handle member and the scoring mechanism include a central opening or pass-through through which the hose can extend. The blade is radially adjustable in a range of the cross-section area of the pass-through. The scoring mechanism and handle are rotatable relative to each other to adjust the radial location of the arm-blade subassembly, as explained above.

In one or more embodiments, the cutting tool can include multiple blades (such as three blades held 120° apart), on simultaneously acting arms. A free end of a hose to be scored is passed through the cutting tool so that the blades are positioned over the hose is on the fitting prior to setting the depth to cut. An adjustment ring (or base member) can be provided to control the cut depth of the blades. This allows the cutting tool to accommodate different hose diameters and wall thicknesses. When the desired depth is set, the tool can be drawn away from the hose-to-fitting attachment location to cut or score the hose in multiple places at once. The cuts are to a depth sufficient to weaken the wall structure of the hose, which allows the hose to then be readily removed. Retracting the blades assists the operator in removing any scrap piece of the hose from the cutting tool once complete.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. A cutting tool comprising:

a handle member with a central opening sized for a hose to pass through the handle member;

a hose scoring mechanism coupled to the handle member, the hose scoring mechanism comprising:

a base member with a central opening sized for the hose to pass through the base member, the base member being coupled to and adjustable relative to the handle member, and the hose passing through the central openings of the handle and base members when the cutting tool is in use; and an arm-blade subassembly adjustably coupled to the base member, the arm-blade subassembly comprising:

a blade; and an arm with a blade-receiving recess and a guide surface, the guide surface configured to physically contact and travel along the hose when the cutting tool is used to score the hose, the blade being coupled to the arm within the blade-receiving recess to extend from the arm a selected penetration depth of the blade into the hose, and the arm being radially adjustable with adjustment of the base member relative to the handle member to facilitate physically contacting the guide surface of the arm to the hose and inserting the blade into the hose the selected penetration depth, wherein with operative drawing of the cutting tool along the hose, the guide surface travels along the hose and the blade longitudinally scores the hose to the selected penetration depth.

2. The cutting tool of claim 1, wherein the blade-receiving recess of the arm is configured such that the blade extends from the arm to penetrate into the hose at a fixed angle relative to the guide surface.

3. The cutting tool of claim 1, wherein the guide surface is an edge surface of the arm extending parallel to the hose when the cutting tool is in use.

4. The cutting tool of claim 1, wherein the arm movably couples to the base member within a radially-extending track of the base member.

5. The cutting tool of claim 4, wherein the arm adjusts within the radially-extending track with rotational movement of the base member relative to the handle member.

6. The cutting tool of claim 5, wherein the handle member includes a spiral groove on an end thereof where the base member couples to the handle member, and the arm includes one or more teeth extending into the spiral groove of the handle member, where in operation, rotation of the base member relative to the handle member produces movement of the teeth within the spiral groove, resulting in radial movement of the arm relative to the hose to facilitate physically contacting the guide surface of the arm to the hose and inserting the blade into the hose the selected penetration depth.

7. The cutting tool of claim 1, wherein the hose scoring mechanism comprises multiple arm-blade subassemblies adjustably coupled to the base member, the arm-blade subassembly being one arm-blade subassembly of the multiple arm-blade subassemblies, and each arm-blade subassembly including a blade coupled to an arm within a blade-receiving recess such that the blade extends from the arm a selected penetration depth of the blade into the hose, and each arm includes a respective guide surface, with the arm being radially adjustable with adjustment of the base member relative to the handle member to facilitate physically contacting the guide surface of the arm to the hose and inserting the blade into the hose the selected penetration depth.

8. The cutting tool of claim 7, wherein the multiple arm-blade subassemblies comprise three arm-blade subassembly spaced apart 120° around the base member, and the three arm-blade subassemblies are simultaneously radially adjustable with rotation of the base member relative to the handle member, wherein the blades of the three arm-blade subassemblies simultaneously score the hose to the selected penetration depth 120° apart when the cutting tool is in use.

9. The cutting tool of claim 1, wherein the hose scoring mechanism further comprises a scoring support arm with a concave scoring support surface sized and configured to physically contact the hose when the cutting tool is in use, the scoring support arm with the concave scoring support surface being located opposite to the arm-blade subassembly to stabilize the cutting tool when scoring the hose.

10. A cutting tool comprising:

a handle member with a central opening sized for a hose to pass through the handle member;

a hose scoring mechanism adjustably coupled to the handle member, the hose scoring mechanism comprising:

a base member with a central opening sized for the hose to pass through the base member, the base member being coupled to and adjustable relative to the handle member, and the hose passing through the central openings of the handle and base members when the cutting tool is in use; and multiple arms extending from the base member and coupled to the base member within respective radially-extending tracks of the base member, the multiple arms adjusting within the respective radially-extending tracks with rotational movement of the base member relative to the handle member, at least one arm of the multiple arms receiving a blade within a blade-receiving recess, the blade being coupled to the arm within the blade-receiving recess to extend from the arm a selected penetration depth of the blade into the hose with the multiple arms moved into physical contact with the hose for the cutting tool to be used to longitudinally score the hose.

11. The cutting tool of claim 10, wherein the blade-receiving recess in the arm is configured such that the blade extends from the arm to penetrate into the hose at a fixed angle relative to the arm.

12. The cutting tool of claim 10, wherein the handle member includes a spiral groove on an end thereof where the base member engages the handle member, and each arm of the multiple arms include one or more teeth extending into the spiral groove of the handle member, wherein in operation, rotation of the base member relative to the handle member produces movement of the teeth within the spiral groove, resulting in radial movement of the arm relative to the hose to facilitate physically contacting the arm to the hose.

13. The cutting tool of claim 10, wherein each arm of the multiple arms includes a blade-receiving recess and a blade, each blade being coupled to the respective arm within the blade-receiving recess thereof to extend from the arm the selected penetration depth of the blade into the hose.

14. The cutting tool of claim 13, wherein the multiple arms comprise three arms spaced apart 120° around the base member, the three arms being simultaneously radially adjustable with rotation of the base member relative to the handle member, and wherein the blades of the three arms simultaneously score the hose to the selected penetration depth 120° apart when the cutting tool is in use.

15. The cutting tool of claim 10, wherein one arm of the multiple arms comprises a scoring support arm with a concave scoring support surface sized and configured to physically contact the hose when the cutting tool is in use, the scoring support arm with the concave scoring support surface being located opposite to a blade-receiving arm of the at least one arm of the multiple arms to stabilize the cutting tool when scoring the hose.

16. The cutting tool of claim 10, wherein the cutting tool is a hand-held cutting tool.

17. A method of fabricating a cutting tool, the method comprising:

providing a handle member with a central opening sized for a hose to pass through the handle member;

adjustably coupling a hose scoring mechanism to the handle member, the adjustably coupling of the hose scoring mechanism including:

rotatably coupling a base member to the handle member, the base member including a central opening sized for the hose to pass through the base member, and the hose passing through the central openings of the handle and base members when the cutting tool is in use; and providing an arm-blade subassembly adjustably coupled to the base member, the providing of the arm-blade subassembly including:

providing a blade;

providing an arm with a blade-receiving recess, and a guide surface configured to physically contact and travel along the hose when the cutting tool is used to longitudinally score the hose; and inserting the blade into the blade-receiving recess of the arm such that the blade extends from the arm a selected penetration depth of the blade into the hose, wherein the arm is radially adjustable with adjustment of the base member relative to the handle member to facilitate physically contacting the guide surface of the arm to the hose and inserting the blade into the hose the selected penetration depth to facilitate the scoring of the hose using the cutting tool.

18. The method of claim 17, wherein providing the arm includes providing the arm with a blade-receiving recess configured such that the blade extends from the arm to penetrate into the hose at a fixed angle relative to the guide surface.

19. The method of claim 17, wherein the guide surface of the arm is an edge surface of the arm extending parallel to the hose when the cutting tool is in use.

20. The method of claim 17, wherein the arm movably couples to the base member within a radially-extending track of the base member.

* * * * *